US011280492B2

(12) United States Patent
Jones et al.

(10) Patent No.: US 11,280,492 B2
(45) Date of Patent: Mar. 22, 2022

(54) COMBUSTOR ASSEMBLY FOR A TURBO MACHINE

(71) Applicant: General Electric Company, Schenectady, NY (US)

(72) Inventors: Ryan Christopher Jones, Cincinnati, OH (US); Donald Lee Gardner, West Chester, OH (US); Paul Christopher Schilling, Waynesville, OH (US); Andrew Scott Bilse, Cincinnati, OH (US); Daniel Endecott Osgood, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 200 days.

(21) Appl. No.: 16/110,162

(22) Filed: Aug. 23, 2018

(65) Prior Publication Data

US 2020/0063961 A1 Feb. 27, 2020

(51) Int. Cl.
*F23R 3/00* (2006.01)
*F23R 3/60* (2006.01)

(52) U.S. Cl.
CPC ..... *F23R 3/002* (2013.01); *F23R 3/60* (2013.01); *F23R 2900/00018* (2013.01)

(58) Field of Classification Search
CPC ..... F23R 3/286; F23R 3/283; F05D 2260/33; F05D 2260/36; F05D 2260/37
See application file for complete search history.

(56) References Cited

U.S. PATENT DOCUMENTS

| | | | | |
|---|---|---|---|---|
| 3,742,704 | A | 7/1973 | Adelizzi et al. | |
| 4,914,918 | A | 4/1990 | Sullivan | |
| 5,355,670 | A | 10/1994 | Sciocchetti | |
| 5,916,142 | A | 6/1999 | Snyder et al. | |
| 6,415,609 | B1 | 7/2002 | Vacek et al. | |
| 6,530,227 | B1 | 3/2003 | Young et al. | |
| 7,121,095 | B2 | 10/2006 | McMasters et al. | |
| 7,475,678 | B2 | 1/2009 | Douyama et al. | |
| 7,581,402 | B2 | 9/2009 | Parker | |
| 7,673,460 | B2 * | 3/2010 | Hernandez | F23R 3/10 60/796 |
| 7,926,281 | B2 | 4/2011 | Commaret et al. | |
| 9,021,812 | B2 | 5/2015 | Pardington et al. | |

(Continued)

FOREIGN PATENT DOCUMENTS

| | | | |
|---|---|---|---|
| CN | 1576698 | A | 2/2005 |
| CN | 107120682 | A | 9/2017 |
| EP | 1486732 | A2 | 12/2004 |

OTHER PUBLICATIONS

Chinese Search Report and Office Action Corresponding to Application No. 201910774271 dated Jun. 30, 2020.

(Continued)

*Primary Examiner* — Ehud Gartenberg
*Assistant Examiner* — Jacek Lisowski
(74) *Attorney, Agent, or Firm* — Venable LLP; Elizabeth C. G. Gitlin; Michele V. Frank

(57) ABSTRACT

Embodiments of a combustor assembly for a turbine engine are generally provided. The combustor assembly includes a first separable portion defining a dome assembly, and a second separable portion defining a deflector assembly. The first separable portion and the second separable portion are coupled together at a fitted interface.

7 Claims, 7 Drawing Sheets

(56) References Cited

U.S. PATENT DOCUMENTS

| | | | |
|---|---|---|---|
| 9,341,374 | B2 | 5/2016 | Ramier et al. |
| 9,683,739 | B2 | 6/2017 | Hicks |
| 9,850,911 | B2 | 12/2017 | Daylan et al. |
| 2004/0143967 | A1 | 7/2004 | Caldwell et al. |
| 2009/0078797 | A1 | 3/2009 | Hernandez et al. |
| 2016/0153660 | A1 | 6/2016 | Drake et al. |
| 2016/0169521 | A1 | 6/2016 | Drake et al. |
| 2016/0201915 | A1 | 7/2016 | Williams et al. |
| 2016/0377292 | A1 | 12/2016 | Prociw |

OTHER PUBLICATIONS

Office Action and Search Report issued in related Chinese Patent Application No. 201910774271.5 dated Jun. 30, 2020 (With English language translation).

* cited by examiner

COMBUSTOR ASSEMBLY FOR A TURBO MACHINE

FIELD

The present subject matter relates generally to combustor assemblies for turbo machines. More specifically, the present subject matter relates to attachment mechanisms to combustor assembly components.

BACKGROUND

Turbo machines, such as gas turbine engines, include combustor assemblies manufactured using welds, brazes, or other bonding processes, such as at a swirler or mixer assembly, a dome assembly, or a deflector assembly. These processes are generally effective in manufacturing combustor assemblies. However, such processes during assembly are costly and complex. Additionally, when a combustor assembly is to be disassembled for repair or refurbishment (e.g., the deflector), such bonding processes result in partial or complete destruction of one or more other components of the combustor during disassembly (e.g., the mixer or the dome) during the process of accessing, disassembling, and replacing another component such as the deflector. Such destruction, such as of the mixer or dome generally, necessitates replacing one or more of these components even if there would have been sufficient structural life but for the need to disassemble the combustor to access or replace other components, such as the deflector.

As such, there is a need for structures that enable disassembly and replacement of components of the combustor without partial or complete destruction of other components as a result of the assembly and disassembly process.

BRIEF DESCRIPTION

Aspects and advantages of the invention will be set forth in part in the following description, or may be obvious from the description, or may be learned through practice of the invention.

Embodiments of a combustor assembly for a turbine engine are generally provided. The combustor assembly includes a first separable portion defining a dome assembly, and a second separable portion defining a deflector assembly. The first separable portion and the second separable portion are coupled together at a fitted interface.

In one embodiment, the fitted interface defines a press fit, an interference fit, a snap fit, or a threaded fit.

In various embodiments, the first separable portion defines a plurality of threads corresponding to the fitted interface. In one embodiment, the first separable portion defines a male threaded interface, and the second threaded portion defines a female threaded interface.

In still various embodiments, the fitted interface defines a bayonet structure at the first separable portion and the second separable portion. In one embodiment, the bayonet structure includes a clip defining a slot at the first separable portion into which the second separable portion is disposed when attached to the first separable portion. In another embodiment, the clip defines a radially extended portion and a circumferentially extended portion. The slot is defined between the circumferentially extended portion and a body portion of the mixer assembly. In yet another embodiment, the clip defines a groove at one or more of the circumferentially extended portion of the first separable portion. The second separable portion is disposed in the groove when attached to the first separable portion.

In still yet various embodiments, the combustor assembly further includes a mechanical fastener disposed through the first separable portion and the second separable portion. In one embodiment, the mechanical fastener is disposed through a groove defined through the first separable portion or the second separable portion.

In one embodiment, the fitted interface defines a key including a first radially extended portion at the first separable portion and a second radially extended portion at the second separable portion.

Embodiments of a gas turbine engine including the combustor assembly are generally provided. The combustor assembly includes the first separable portion defining a dome assembly and the second separable portion defining a mixer assembly. The first separable portion and the second separable portion are coupled together at a fitted interface.

In one embodiment, the fitted interface between the dome assembly and the mixer assembly defines a press fit, an interference fit, a snap fit, or a threaded fit.

In various embodiments, the first separable portion of the dome assembly defines a plurality of threads corresponding to the fitted interface. In one embodiment, the first separable portion of the dome assembly defines a male threaded interface, and the second threaded portion of the mixer assembly defines a female threaded interface.

In still various embodiments, the fitted interface between the dome assembly and the mixer assembly defines a bayonet structure at the first separable portion and the second separable portion. In one embodiment, the bayonet structure includes a clip defining a slot at the second separable portion of the mixer assembly into which the first separable portion of the dome assembly is disposed when attached to the second separable portion. In another embodiment, the clip defines a radially extended portion and a circumferentially extended portion. The slot is defined between the circumferentially extended portion and a body portion of the mixer assembly.

In one embodiment, the combustor assembly further includes a mechanical fastener disposed through a groove defined through the first separable portion or the second separable portion.

In another embodiment, the fitted interface defines a key including a first radially extended portion at the first separable portion of the dome assembly and a second radially extended portion at the second separable portion of the mixer assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
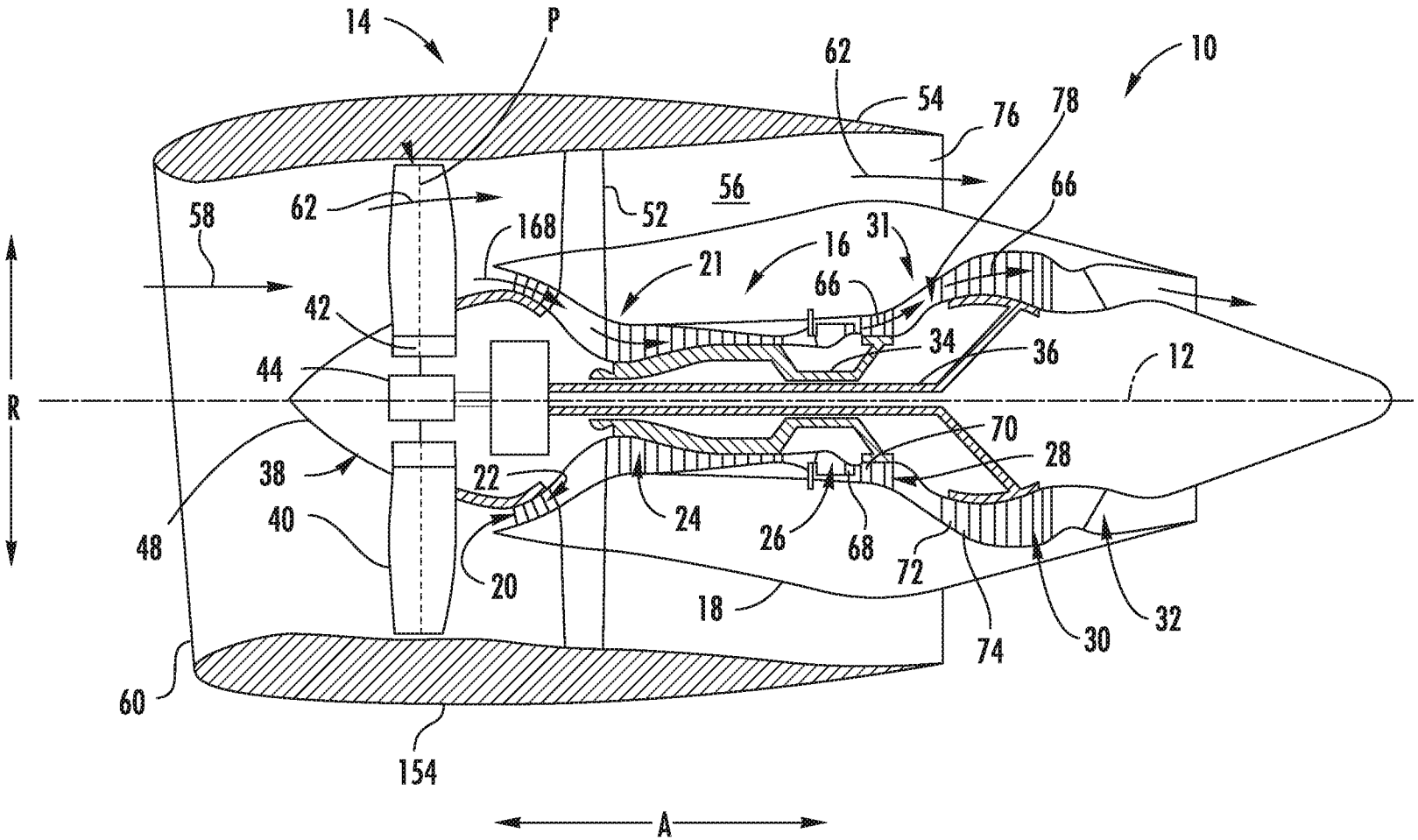
FIG. 1 is a schematic, cross-sectional view of an exemplary embodiment of a turbo machine engine according to various embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Embodiments of a combustor assembly for a turbo machine are generally provided that includes structures that enable disassembly and replacement of components of the combustor without partial or complete destruction of other components as a result of the assembly and disassembly process. Various embodiments of the combustor assembly provided herein improve combustor assembly cost of manufacture, repair, and component replacement, such as by obviating welds, brazes, or other bonding processes at portions of the combustor assembly such as described herein. For example, various embodiments of the combustor assembly shown and described herein provide for assembly and disassembly of a dome assembly and/or mixer assembly to a deflector assembly without welds, brazes, or other bonding processes, such as to enable re-use of the dome assembly and/or mixer assembly when disassembling from the deflector assembly. As such, the deflector assembly, generally exposed to high temperatures and high temperature gradients, may be replaced without necessitating replacement of the dome assembly and/or mixer assembly, which are generally exposed to lower temperatures and lower temperature gradients.

Referring now to the drawings, wherein identical numerals indicate the same elements throughout the figures, FIG. 1 is a schematic cross-sectional view of a turbo machine in accordance with an exemplary embodiment of the present disclosure. More particularly, for the embodiment of FIG. 1, the turbo machine defines a gas turbine engine 10, referred to herein as "engine 10." As shown in FIG. 1, the engine 10 defines an axial direction A (extending parallel to a longitudinal centerline 12 provided for reference) and a radial direction R.

In general, the engine 10 includes a fan section 14 and a core engine 16 disposed downstream from the fan section 14. The exemplary core engine 16 depicted generally includes a substantially tubular outer casing 18 that defines an annular inlet 20. The outer casing 18 encases, in serial flow relationship, a compressor section 21 including a booster or low pressure (LP) compressor 22 and a high pressure (HP) compressor 24; a combustion section 26; a turbine section 31 including a high pressure (HP) turbine 28 and a low pressure (LP) turbine 30; and a jet exhaust nozzle section 32. A high pressure (HP) shaft 34 drivingly connects the HP turbine 28 to the HP compressor 24, together defining a HP spool. A low pressure (LP) shaft drivingly connects the LP turbine 30 to the LP compressor 22, together defining an LP spool. It should be appreciated that other embodiments of the engine 10 not depicted may further an intermediate pressure (IP) spool defined by an IP compressor drivingly connected to an IP turbine via an IP shaft, in which the IP spool is disposed in serial flow relationship between the LP spool and the HP spool.

For the embodiment depicted, the fan section 14 includes a variable pitch fan 38 having a plurality of fan blades 40 coupled to a disk 42 in a spaced apart manner. As depicted, the fan blades 40 extend outwardly from the disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear assembly 46. The power gear assembly 46 includes a plurality of gears for providing a different rotational speed of the fan section 14 relative to the LP shaft 36, such as to enable a more efficient fan speed and/or LP spool rotational speed.

Referring still to the exemplary embodiment of FIG. 1, the disk 42 is covered by rotatable spinner cap 48 aerodynamically contoured to promote an airflow through the plurality of fan blades 40. Additionally, the exemplary fan section 14 includes a fan casing or outer nacelle 50 that circumferentially surrounds the fan 38 and/or at least a portion of the core engine 16. It should be appreciated that the nacelle 50 may be configured to be supported relative to the core engine 16 by a plurality of circumferentially-spaced outlet guide vanes 52. Moreover, a downstream section 54 of the nacelle 50 may extend over an outer portion of the core engine 16 so as to define a bypass airflow passage 56 therebetween.

During operation of the engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with a liquid and/or gaseous fuel and burned to produce combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft 34, thus causing the HP shaft to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core engine 16.

It should be appreciated, however, that the exemplary engine 10 depicted in FIG. 1 is by way of example only, and that in other exemplary embodiments, the engine 10 may have any other suitable configuration, such as, but not limited to, turboprop, turboshaft, turbojet, or prop-fan configurations for aviation, marine, or power generation purposes. Still further, other suitable configurations may include steam turbine engines or other Brayton cycle machines.

Figure 2:
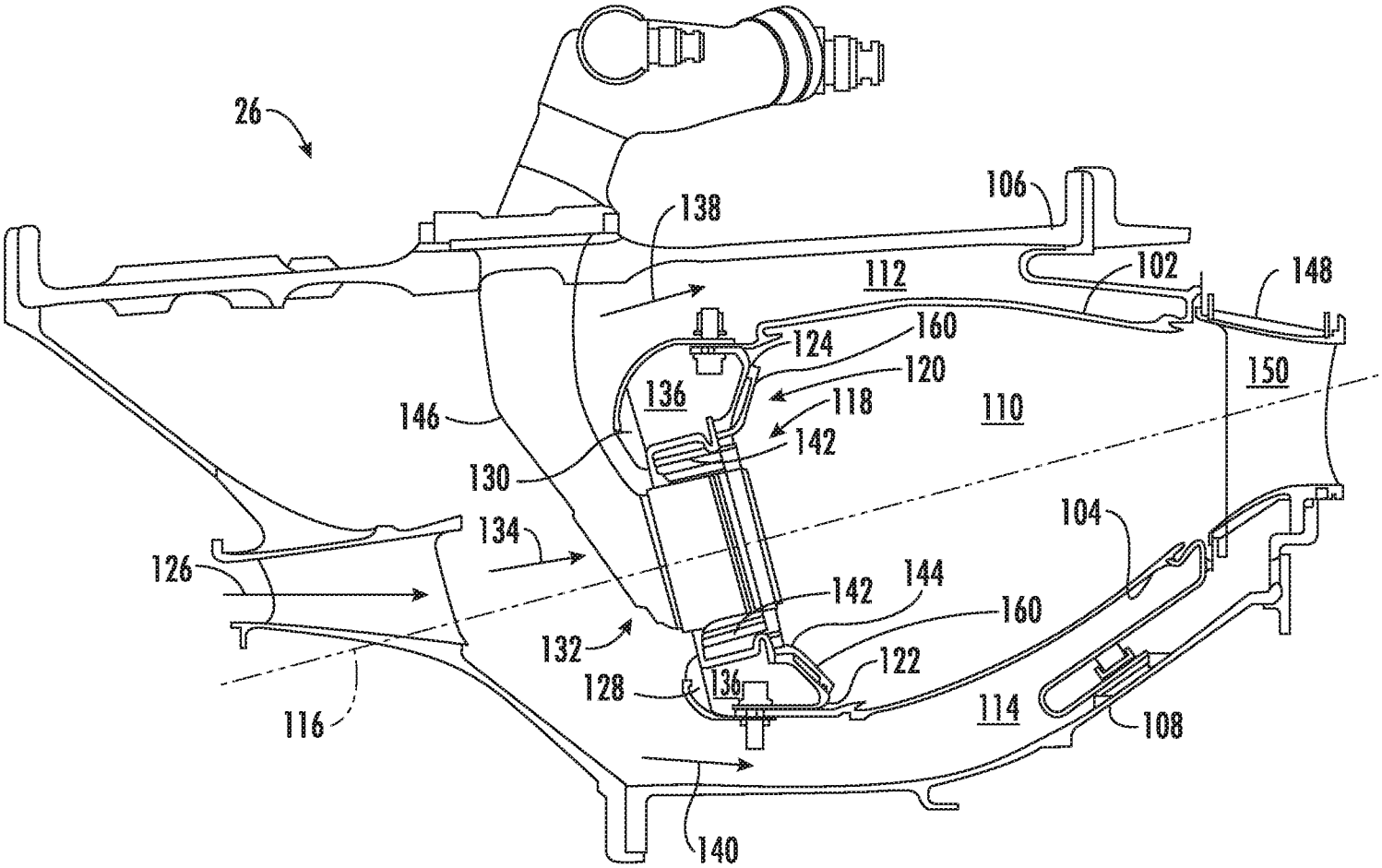
FIG. 2 is a schematic, cross-sectional view of an exemplary embodiment of a combustion section of the engine shown in FIG. 1.
Figure 3:
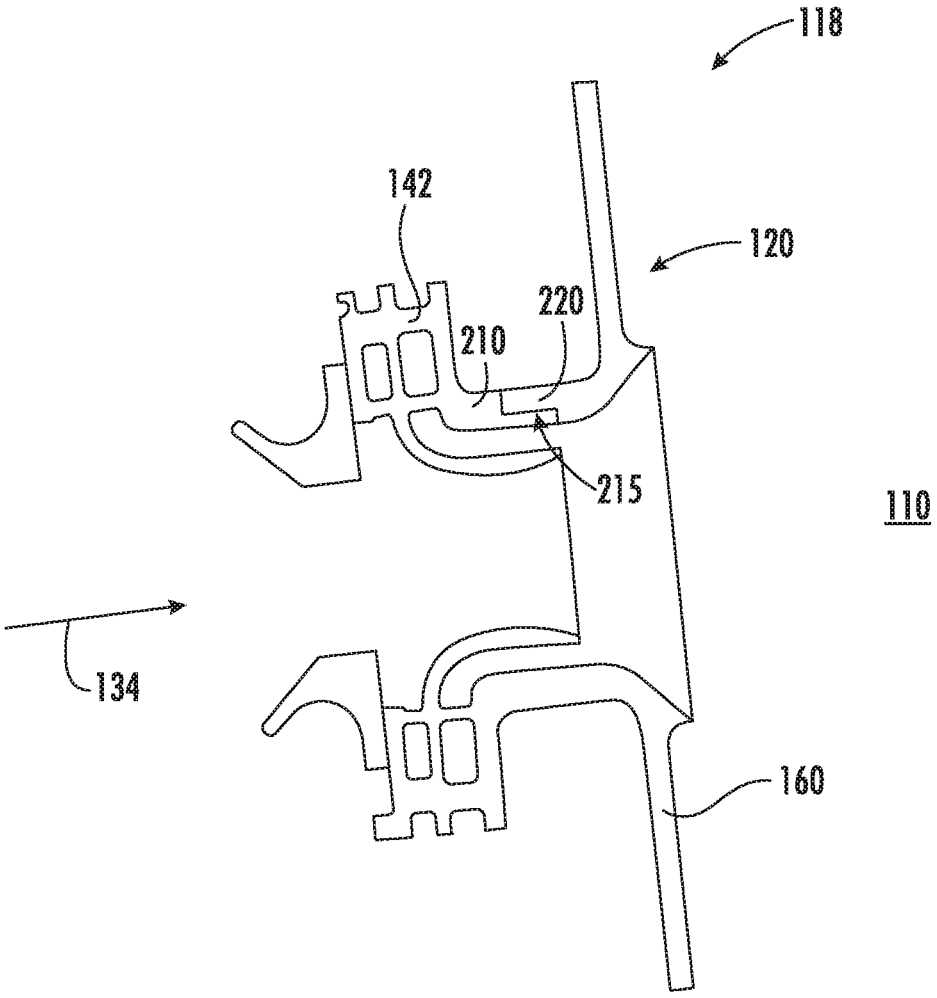
FIG. 3 is a schematic, cross-sectional view of an exemplary embodiment of a portion of the combustion section shown in FIG. 2.

Referring now to FIG. 2, a schematic cross-sectional view of one exemplary embodiment of a combustion section 26 suitable for use within the engine 10 described above is generally provided. Various embodiments of the combustion section 26 may further define a rich burn or lean burn combustor configuration. In the exemplary embodiment, the combustion section 26 includes an annular combustor. However, one skilled in the art will appreciate that the combustor may be any other combustor, including, but not limited to, a single or double annular combustor, a can-combustor, or a can-annular combustor.

As shown in FIG. 2, combustion section 26 includes an outer liner 102 and an inner liner 104 disposed between an outer combustor casing 106 and an inner combustor casing 108. Outer and inner liners 102 and 104 are spaced radially from each other such that a combustion chamber 110 is defined therebetween. Outer liner 102 and outer casing 106 form an outer passage 112 therebetween, and inner liner 104 and inner casing 108 form an inner passage 114 therebetween. Combustion section 26 also includes a longitudinal axis 116 which extends from a forward end to an aft end of the combustion section 26 as shown in FIG. 2.

The combustion section 26 may also include a combustor assembly 118 comprising an annular dome assembly 120 mounted upstream of the combustion chamber 110 that is configured to be coupled to the forward ends of the outer and inner liners 102, 104. More particularly, the combustor assembly 118 includes an inner annular dome 122 attached to the forward end of the inner liner 104 and an outer annular dome 124 attached to the forward end of the outer liner 102.

As shown in FIG. 2, the combustion section 26 may be configured to receive an annular stream of pressurized compressor discharge air 126 from a discharge outlet of the high pressure compressor 24. To assist in directing the compressed air, the annular dome assembly 120 may further comprise an inner cowl 128 and an outer cowl 130 which may be coupled to the upstream ends of inner and outer liners 104 and 102, respectively. In this regard, an annular opening 132 formed between inner cowl 128 and outer cowl 130 enables compressed fluid to enter combustion section 26 through a diffuse opening in a direction generally indicated by arrow 134. The compressed air may enter into a first cavity 136 defined at least in part by the annular dome assembly 120. As will be discussed in more detail below, a portion of the compressed air in the first cavity 136 may be used for combustion, while another portion may be used for cooling the combustion section 26.

In addition to directing air into first cavity 136 and the combustion chamber 110, the inner and outer cowls 128, 130 may direct a portion of the compressed air around the outside of the combustion chamber 110 to facilitate cooling liners 102 and 104. For example, as shown in FIG. 2, a portion of the compressor discharge air 126 may flow around the combustion chamber 110, as indicated by arrows 138 and 140, to provide cooling air to outer passage 112 and inner passage 114, respectively.

In certain exemplary embodiments, the inner dome 122 may be formed integrally as a single annular component, and similarly, the outer dome 124 may also be formed integrally as a single annular component. In still certain embodiments, the inner dome 122 and the outer dome 124 may together be formed as a single integral component. In still various embodiments, the dome assembly 120, including one or more of the inner dome 122, the outer dome 124, the outer linter 102, or the inner liner 104, may be formed as a single integral component. It should be appreciated, however, that in other exemplary embodiments, the inner dome 122 and/or the outer dome 124 may alternatively be formed by one or more components joined in any suitable manner. For example, with reference to the outer dome 124, in certain exemplary embodiments, the outer cowl 130 may be formed separately from the outer dome 124 and attached to the forward end of the outer dome 124 using, e.g., a welding process, a mechanical fastener, a bonding process or adhesive, or a composite layup process. Additionally, or alternatively, the inner dome 122 may have a similar configuration.

The combustor assembly 118 further includes a plurality of mixer assemblies 142 spaced along a circumferential direction between the outer annular dome 124 and the inner dome 122. In this regard, a plurality of circumferentially-spaced contoured cups 144 may be formed in the annular dome assembly 120, and each cup 144 defines an opening in which a swirler, cyclone, or mixer assembly 142 is mounted, attached, or otherwise integrated for introducing the air/fuel mixture into the combustion chamber 110. Notably, compressed air may be directed from the combustion section 26 into or through one or more of the mixer assemblies 142 to support combustion in the upstream end of the combustion chamber 110.

A liquid and/or gaseous fuel is transported to the combustion section 26 by a fuel distribution system (not shown), where it is introduced at the front end of a burner in a highly atomized spray from a fuel nozzle. In an exemplary embodiment, each mixer assembly 142 may define an opening for receiving a fuel injector 146 (details are omitted for clarity). The fuel injector 146 may inject fuel in an axial direction (i.e., along longitudinal axis 116) as well as in a generally radial direction, where the fuel may be swirled with the incoming compressed air. Thus, each mixer assembly 142 receives compressed air from annular opening 132 and fuel from a corresponding fuel injector 146. Fuel and pressurized air are swirled and mixed together by mixer assemblies 142, and the resulting fuel/air mixture is discharged into combustion chamber 110 for combustion thereof.

The combustion section 26 may further comprise an ignition assembly (e.g., one or more igniters extending through the outer liner 102) suitable for igniting the fuel-air mixture. However, details of the fuel injectors and ignition assembly are omitted in FIG. 2 for clarity. Upon ignition, the resulting combustion gases may flow in a generally axial direction (along longitudinal axis 116) through the combustion chamber 110 into and through the turbine section of the engine 10 where a portion of thermal and/or kinetic energy from the combustion gases is extracted via sequential stages of turbine stator vanes and turbine rotor blades. More specifically, the combustion gases may flow into an annular, first stage turbine nozzle 148. As is generally understood, the nozzle 148 may be defined by an annular flow channel that includes a plurality of radially-extending, circularly-spaced nozzle vanes 150 that turn the gases so that they flow angularly and impinge upon the first stage turbine blades (not shown) of the HP turbine 28 (FIG. 1).

Referring still to FIG. 2, the plurality of mixer assemblies 142 are placed circumferentially within the annular dome assembly 120 around the engine 10. Fuel injectors 146 are disposed in each mixer assembly 142 to provide fuel and support the combustion process. Each dome has a heat shield, for example, a deflector assembly 160, which thermally insulates the annular dome assembly 120 from the extremely high temperatures generated in the combustion chamber 110 during engine operation. The inner and outer annular domes 122, 124 and the deflector assembly 160 may define a plurality of openings (e.g., contoured cups 144) for receiving the mixer assemblies 142. As shown the plurality of openings are, in one embodiment, circular. However, it should be appreciated that in other embodiments, the openings are ovular, elliptical, polygonal, oblong, or other non-circular cross sections.

Compressed air (e.g., 126) flows into the annular opening 132 where a portion of the air 126 will be used to mix with fuel for combustion and another portion will be used for cooling the dome deflector assembly 160. Compressed air may flow around the fuel injector 146 and through the mixing vanes around the circumference of the mixing assemblies 142, where compressed air is mixed with fuel and directed into the combustion chamber 110. Another portion of the air enters into a cavity 136 defined by the annular dome assembly 120 and the inner and outer cowls 128, 130. The compressed air in cavity 136 is used, at least in part, to cool the annular dome assembly 120 and the deflector assembly 160.

Referring now to FIGS. 3-11, schematic cross sectional views of exemplary embodiments of the mixer assembly 142 and the deflector assembly 160 are generally provided. The combustor assembly 118 includes a first separable portion 210 defining at least a portion of the mixer assembly 142 and a second separable portion 220 defining at least a portion of the deflector assembly 160. The first separable portion 210 and the second separable portion 220 are coupled together at a fitted interface 215.

Figure 4:
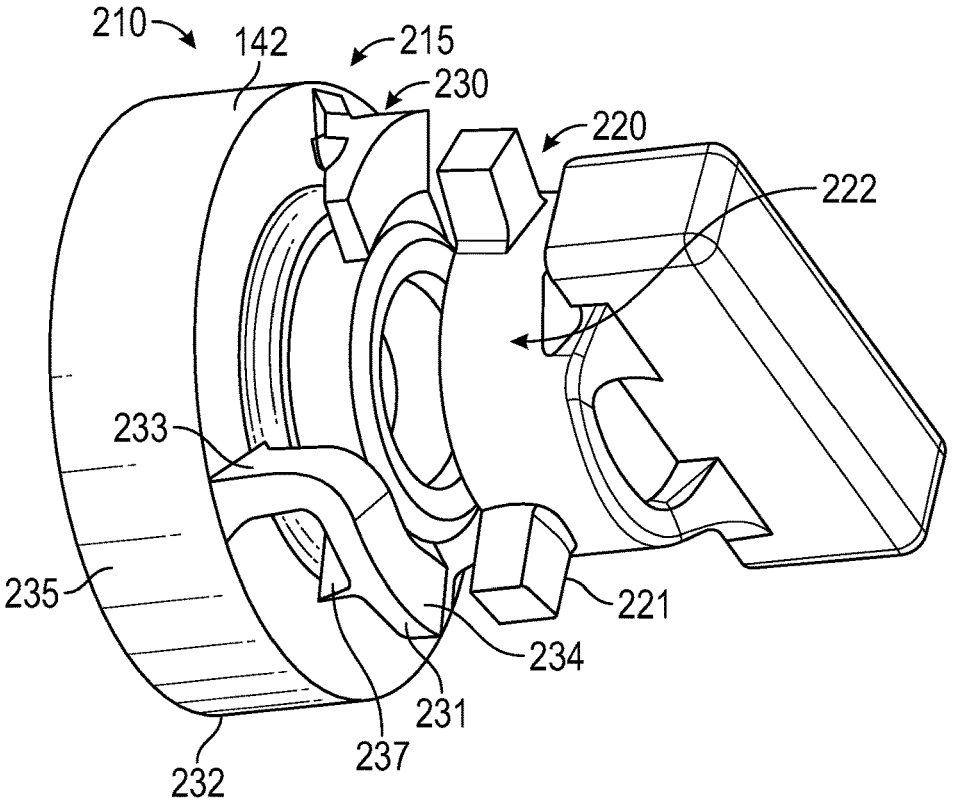
FIG. 4 is an exploded perspective view of an exemplary embodiment of a portion of the combustion section shown in FIG. 3.
Figure 5:
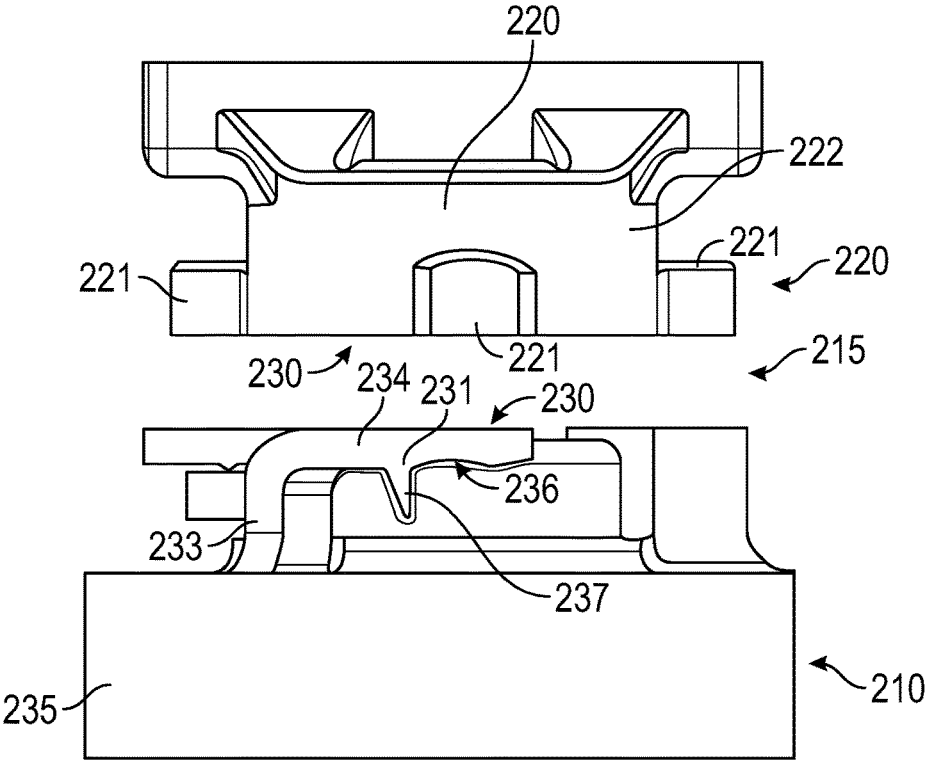
FIG. 5 is an exploded side view of an exemplary embodiment a of portion of the combustion section shown in FIGS. 3-4.

Referring to the exploded views generally provided in regard to FIGS. 4-5, in various embodiments, the fitted interface 215 defines a bayonet structure 230 at the first separable portion 210 and the second separable portion 220. The bayonet structure 230 may include a clip 231 defining a slot 232 at the first separable portion 210 into which the second separable portion 220 is disposed when attached to the first separable portion 210. In one embodiment, the clip 231 defines a radially extended portion 233, a circumferentially extended portion 234, and a second radially extended ortion 237. The slot 232 is defined between the circumferentially extended portion 234 and a body portion 235 of the first separable portion 210. In another embodiment, such as generally depicted in regard to FIG. 5 and FIGS. 7A-7B, the clip 231 may further define a groove 236 at one or more of the circumferentially extended portion 234 of the first separable portion 210. For example, the groove 236 may be defined between the circumferentially extended portion 234 and the body portion 235. As another exampie, the groove 236 may be disposed within the slot 232 adjacent to the body portion 235.

Figure 6:
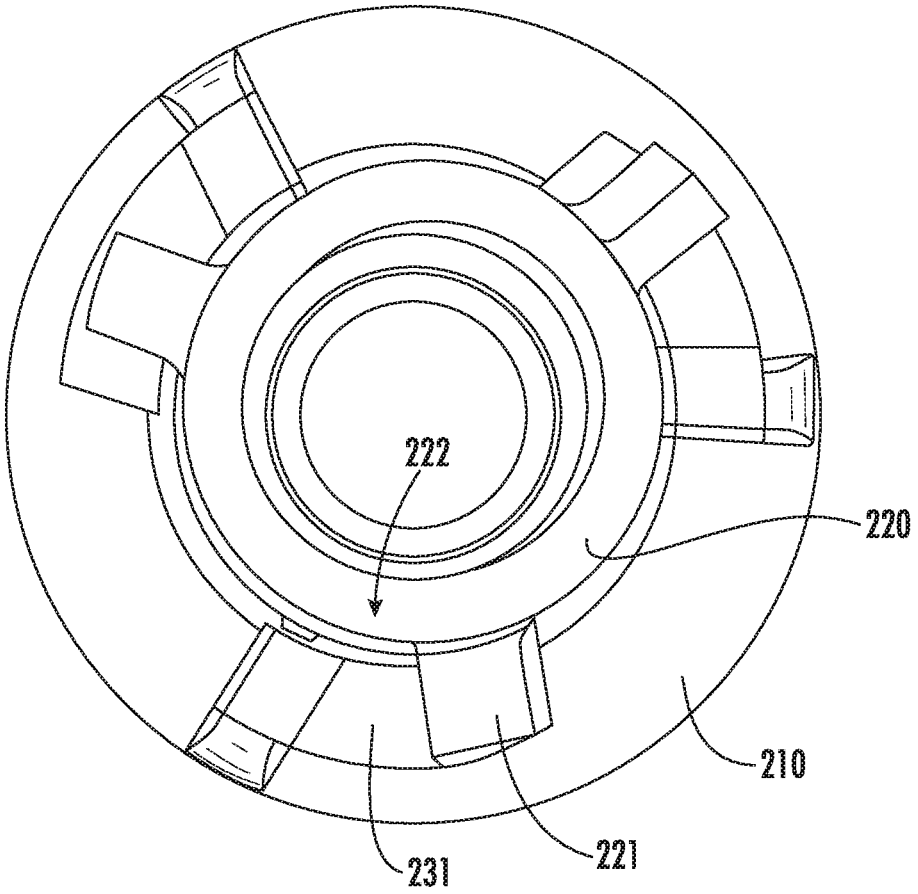
FIG. 6 is a flowpath cross-sectional view of an exemplary embodiment of a portion of the combustion section shown in FIG. 3.

In one embodiment, the slot 232 is defined via the clip 231 extended from the first separable portion 210, such as generally depicted in regard to FIGS. 4-6. In another embodiment, such as generally depicted in regard to FIG. 8, the clip 231 is extended from the second separable portion 220. Regarding FIGS. 4-8, the clip 231 may generally be extended from either the first separable portion 210 or the second separable portion 220 such as to couple the other portion to one another. For example, in regard to FIG. 8, the first separable portion 210 may define a retention portion 211 extended from the body portion 235 of the first separable portion 210 such as to engage the second separable portion 220 within the slot 232 at the clip 231 defined from the second separable portion 220.

Figure 7A:
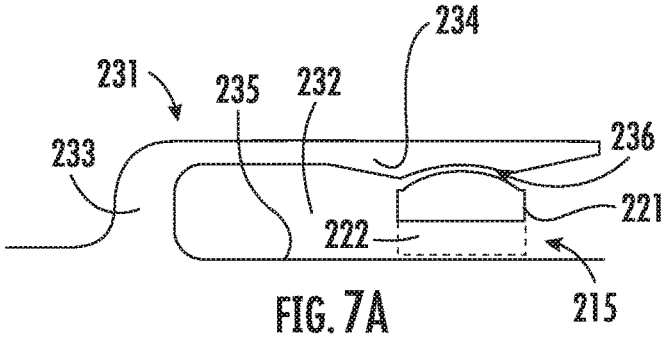
FIG. 7A is a schematic, cross-sectional side view of a portion of the combustion section shown in FIGS. 4-6.
Figure 7B:
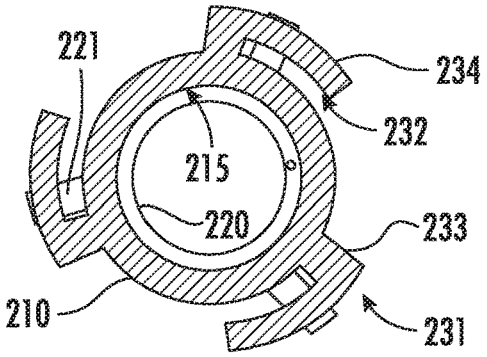
FIG. 7B is a schematic, top view of a portion of the combustion section shown in FIGS. 4-6 and FIG. 7A.

Referring to FIGS. 7A-7B, and in conjunction with FIG. 5, the second separable portion 220 may be disposed in the groove 236 when attached to the first separable portion 210. In various embodiments, the second separable portion 220 may slide into the slot 232 into or past the groove 236 such as to couple a retention portion 221 of the second separable portion 220 within the clip 231 and the body portion 235 of the first separable portion 210. As generally depicted in FIGS. 4-7, the retention portion 221 of the second separable portion 220 may generally define a member extended radially from a generally cylindrical second body portion 222 of the second separable portion 220.

Figure 12:
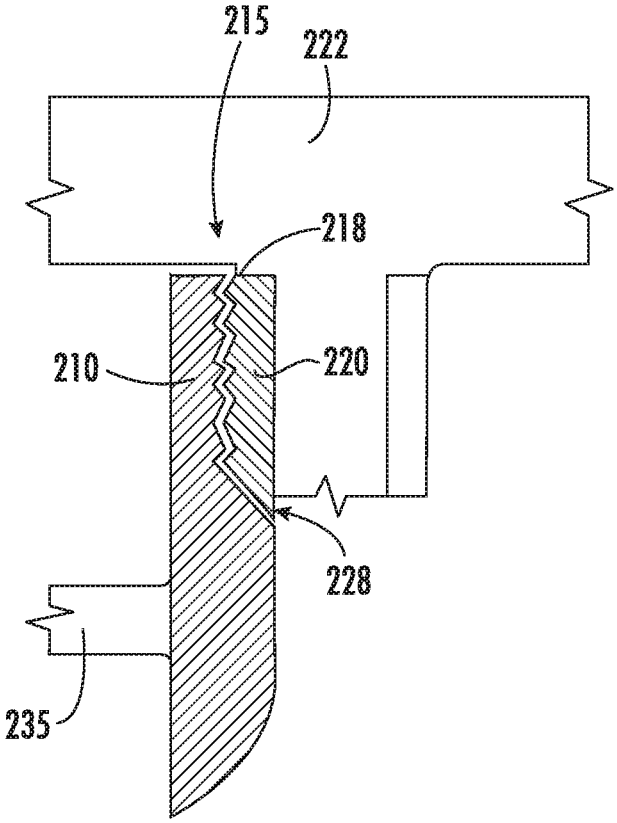
FIG. 12 is a schematic, cross-sectional view of an exemplary embodiment of a portion of the combustion section shown in FIG. 3.

Referring now to FIG. 12, another exemplary embodiment of the fitted interface 215 at the first separable portion 210 and the second separable portion 220 is generally provided. In one embodiment, the first separable portion 210 defines a plurality of threads 218 corresponding to the fitted interface 215.

In various embodiments, the plurality of threads 218 at the fitted interface 215 includes a male threaded interface and a female threaded interface. The fitted interface 215 may generally define the female threaded interface of the plurality of threads 218 along the outer diameter or surrounding surface over an inner diameter or inner surface. For example, referring to FIG. 3, the second separable portion 220 may define the female threaded interface and the first separable portion 210 may define the male threaded interface. As another example, referring to FIG. 10, the first separable portion 210, defining an outer diameter or surrounding surface relative to the second separable portion 220, may define the female threaded interface and the second separable portion 220 defines the male threaded interface. In still various embodiments, the plurality of threads 218 at the fitted interface 215 may be configured to enable threading or screwing the first separable portion 210 defining at least a portion of the mixer assembly 142 (FIG. 2) onto the second separable portion 220 defining at least a portion of the deflector assembly 160 (FIG. 2).

Referring still to FIG. 12, the plurality of threads 218 may further include a ballnose feature 228 between the male threaded interface and the female threaded interface of the plurality of threads 218. The ballnose feature 228 may define a rounded end or radius configured to provide an air seal between the plurality of threads 218.

All or part of the combustor assembly 118 including the first separable portion 210 of the mixer assembly 142 and the second separable portion 220 of the deflector assembly 160 may be manufactured by one or more processes or methods known in the art, such as, but not limited to, machining processes, additive manufacturing, layups, casting, or combinations thereof. The combustor assembly 118 may include any suitable material for a combustor assembly 118 for a turbine engine 10, such as, but not limited to, iron and iron-based alloys, steel and stainless steel alloys, nickel and cobalt-based alloys, titanium and titanium-based alloys, ceramic or metal matrix composites, or combinations thereof.

In various embodiments, the fitted interface 215 defines a press fit, an interference fit, or a snap fit. For example, referring to FIG. 3 generally, or further depicted in regard to FIGS. 8-9, the first separable portion 210, the second separable portion 220, or both, may define an internal dimension or external dimension exceeding a corresponding external dimension or internal dimension of the other structure at the fitted interface 215.

Embodiments of the combustor assembly 118 shown and described herein may include coupling or attaching the first separable portion 210 to the second separable portion 220 at the fitted interface 215 via one or more methods including press fit, tight fit, interference fit, threading, or combinations thereof. Methods or processes for joining the first separable portion 210 and the second separable portion 220 include heating an outer diameter (e.g., the second separable portion 220 in regard to FIG. 8-9, the first separable portion 210 in regard to FIGS. 10-11, the clip 231 in regard to FIGS. 4-7, etc.) and/or cooling an inner diameter (e.g., the first separable portion 210 in regard to FIG. 8-9, the second separable portion 220 in regard to FIG. 10-11, the second separable portion 220 in regard to FIGS. 4-7, etc.).

In still various embodiments of the combustor assembly 118 shown and described herein, a mechanical fastener 240 (FIGS. 8 and 11) may be disposed through the first separable portion 210 and the second separable portion 220 such as to retain together the first separable portion 210 and the second separable portion 220. For example, referring to FIG. 11, the mechanical fastener 240 may be disposed through a groove 217 defined through the first separable portion 210 and/or the second separable portion 220. In one embodiment, the groove 217 is defined through the fitted interface 215 at the first separable portion 210 and the second separable portion 220. In various embodiments, the mechanical fastener 240 may include, but is not limited to, a screw, bolt, pin, tie rod, etc. Although not further depicted, the mechanical fastener 240 may include a nut or other retaining device for a bolt, pin, tie rod, etc., or an insert, such as a helical insert disposed within the groove 217 such as to aid or enable retention of the mechanical fastener 240, the first separable portion 210, and the second separable portion 220.

Figure 11:
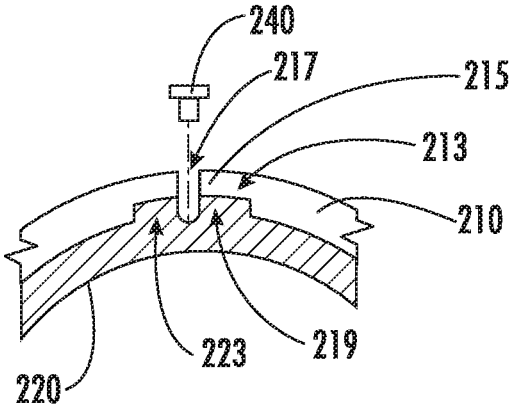

Still further, the groove 217 in regard to FIG. 11 is depicted as extended completely through the first separable portion 210 and partially through the second separable portion 220, such as to prevent the mechanical fastener 240 from extending through an inner diameter of the second separable portion 220 (e.g., such as to prevent the mechanical fastener 240 from extending into a flow path radially inward of the second separable portion 220). However, it should be appreciated that other embodiments may extend the groove 217 completely through the first separable portion 210 and the second separable portion 220.

Figure 8:
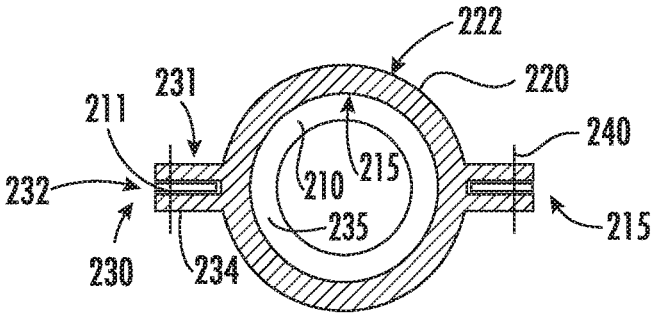
FIGS. 8-11 are cutaway flowpath cross-sectional views of exemplary embodiments of a portion of the combustion section shown in FIG. 3.
Figure 9:
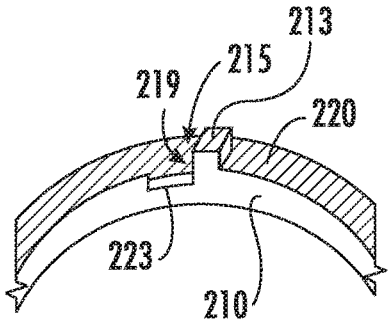
Figure 10:
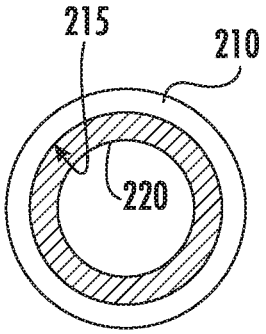

Alternatively, the first separable portion 210 and the second separable portion 220 may be disposed such as generally shown in regard to FIGS. 8-9, in which the second separable portion 220 defines an outer diameter or outer surface surrounding the first separable portion 210. As such, in one embodiment (not depicted), the groove 240 may extend completely through the second separable portion 220 and partially through the first separable portion 210.

Referring to FIGS. 9 and 11, the fitted interface 215 may define a key feature 219 at the first separable portion 210 and the second separable portion 220. In one embodiment, the key feature 219 includes a first radially extended portion 213 at the first separable portion 210 and a second radially extended portion 223 at the second separable portion 220. Each of the radially extended portions 213, 223 are configured to correspond with one another such as to inhibit rotation or axial movement of the first separable portion 210 and the second separable portion 220 relative to one another.

Various embodiments of the combustor assembly 118 generally provided herein may define the first separable portion 210 and the second separable portion 220 to couple the deflector assembly 160, defined at least in part by the second separable portion 220, to the dome assembly 120 of the combustor assembly 118. In one embodiment, the first separable portion 210 may define, at least in part, the dome assembly 120. In other embodiments, the mixer assembly 142 may be at least partially coupled to or fixed to the dome assembly 120. For example, the deflector assembly 160 defined at least in part by the second separable portion 220 may be coupled to the dome assembly 120 and/or mixer assembly 142 via one or more methods or structures generally provided herein, such as, but not limited to, a press fit, an interference fit, or a snap fit.

It should be appreciated that the various embodiments of the combustor assembly 118 shown and described herein include the first separable portion 210 and the second separable portion 220 configured to affix and remove from one another without welding, brazing, or other forms of bonding in which disassembly, separation, or disconnection of the first separable portion 210 from the second separable portion 220 results in partial or complete damage or destruction of one or another of the portions 210, 220. For example, disassembly of the combustor assembly 118 including the first separable portion 210 and the second separable portion 220 may include applying heat to an outer surface or diameter or removing heat (i.e., cooling) from an inner surface or diameter such as to open tolerances that enable parting the first separable portion 210 and the second separable portion 220 without partial or complete destruction to either portion 210, 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly, the combustor assembly comprising:

a first separable portion defining a dome assembly, the first separable portion comprising:

a first separable portion body;

a clip extending radially from the first separable portion body, the clip having a first radially extended portion, a circumferentially extended portion, and a second radially extended portion extending radially inward from an end of the circumferentially extended portion;

a slot defined between the first radially extended portion, the second radially extended portion, the circumferentially extended portion, and an axial face of the first separable portion body; and a second separable portion defining a deflector assembly, the second separable portion comprising:

a second separable portion body; and a retention portion extending radially from the second separable portion, wherein the retention portion is received within the slot when the first separable portion and the second separable portion are coupled together to form a fitted interface, and wherein the dome assembly is assembled to the deflector assembly without welds, brazes, or other bonding processes.

2. The combustor assembly of claim 1, wherein the fitted interface defines a press fit, an interference fit, a snap fit, or a threaded fit.

3. The combustor assembly of claim 1, wherein the clip and the retention portion define a bayonet structure at the first separable portion and the second separable portion.

4. The combustor assembly of claim 1, wherein the clip defines a groove at the circumferentially extended portion of the first separable portion, wherein the retention portion of the second separable portion is disposed in the groove when attached to the first separable portion.

5. A gas turbine engine, the gas turbine engine comprising:

a combustor assembly comprising a first separable portion defining a dome assembly, the first separable portion comprising:

a first separable portion body;

a clip extending radially from the first separable portion body, the clip having a first radially extended portion, a circumferentially extended portion, and a second radially extended portion extending radially inward from an end of the circumferentially extended portion;

a slot defined between the first radially extended portion, the second radially extended portion, the circumferentially extended portion, and an axial face of the first separable portion body; and a second separable portion defining a mixer assembly, the second separable portion comprising:

a second separable portion body; and a retention portion extending radially from the second separable portion, wherein the retention portion is received within the slot when the first separable portion and the second separable portion are coupled together to form a fitted interface, and wherein the dome assembly is assembled to the mixer assembly without welds, brazes, or other bonding processes.

6. The gas turbine engine of claim 5, wherein the fitted interface defines a press fit, an interference fit, a snap fit, or a threaded fit.

7. The gas turbine engine of claim 5, wherein the clip and the retention portion define a bayonet structure at the first separable portion and the second separable portion.

* * * * *